US012570337B2

(12) United States Patent
Pan et al.

(10) Patent No.: US 12,570,337 B2
(45) Date of Patent: Mar. 10, 2026

(54) SWITCH CONTROL METHOD FOR RAIL TRANSIT SIGNAL SYSTEM, AND APPARATUS FOR METHOD

(71) Applicant: CASCO SIGNAL LTD., Shanghai (CN)

(72) Inventors: Liang Pan, Shanghai (CN); Xiaoyong Wang, Shanghai (CN); Haigui Xu, Shanghai (CN); Yanyang Xing, Shanghai (CN); Yiran Lu, Shanghai (CN); Shaowen Chen, Shanghai (CN); Lingjiao Hong, Shanghai (CN)

(73) Assignee: CASCO SIGNAL LTD., Shanghai (CN)

( * ) Notice: Subject to any disclaimer, the term of this patent is extended or adjusted under 35 U.S.C. 154(b) by 601 days.

(21) Appl. No.: 18/003,494

(22) PCT Filed: Sep. 22, 2021

(86) PCT No.: PCT/CN2021/119538
§ 371 (c)(1),
(2) Date: Dec. 27, 2022

(87) PCT Pub. No.: WO2023/272966
PCT Pub. Date: Jan. 5, 2023

(65) Prior Publication Data

US 2023/0415797 A1 Dec. 28, 2023

(30) Foreign Application Priority Data

Jun. 28, 2021 (CN) ..... 202110718526.3

(51) Int. Cl.
*B61L 5/06* (2006.01)
*B61L 7/06* (2006.01)
(Continued)

(52) U.S. Cl.
CPC ..... *B61L 5/06* (2013.01); *B61L 7/06* (2013.01); *B61L 19/16* (2013.01); *B61L 21/04* (2013.01);
(Continued)

(58) Field of Classification Search
CPC .. B61L 5/06; B61L 27/53; B61L 19/16; B61L 21/04
(Continued)

(56) References Cited

U.S. PATENT DOCUMENTS 3,721,819 A * 3/1973 Samrok ..... G08G 3/00 246/118
4,611,775 A * 9/1986 Petit ..... B61L 7/06 246/220
(Continued)

FOREIGN PATENT DOCUMENTS

CN 108182855 A 6/2018
CN 110040155 A 7/2019
(Continued)

OTHER PUBLICATIONS

International Search Report (with English translation) and Written Opinion issued in PCT/CN2021/119538, dated Mar. 29, 2022, 10 pages provided.
Yuan et al., "The Application of Seltrac Control System of Urban Rail Transit", Urban Rapid Rail Transit, vol. 17, No. 4, 2004, pp. 48-51, with English translation.

*Primary Examiner* — Troy Chambers
(74) *Attorney, Agent, or Firm* — HSML P.C.

(57) ABSTRACT

The present disclosure relates to a switch control method for a rail transit signal system, and an apparatus for the method. When a switch control command of the signal system fails or the signal system confirms agreement with local switch control, the method is configured for performing maintenance operation on a switch via the local switch control apparatus. Compared to the prior art, the present disclosure has the advantages of meeting the requirement of the local
(Continued)

switch control, ensuring the safety of a maintenance person and operation, etc.

6 Claims, 7 Drawing Sheets

(51) Int. Cl.
*B61L 19/16* (2006.01)
*B61L 21/04* (2006.01)
*B61L 27/53* (2022.01)
*B61L 27/20* (2022.01)

(52) U.S. Cl.
CPC ..... *B61L 27/53* (2022.01); *B61L 2027/202* (2022.01); *B61L 2027/204* (2022.01)

(58) Field of Classification Search
USPC ..... 246/234
See application file for complete search history.

(56) References Cited

U.S. PATENT DOCUMENTS

| | | | | |
|---|---|---|---|---|
| 5,050,823 | A | 9/1991 | Parker | |
| 5,775,647 | A * | 7/1998 | Wyatt | B61L 5/045 246/258 |
| 5,806,809 | A * | 9/1998 | Danner | B61L 5/107 246/220 |
| 6,556,898 | B2 * | 4/2003 | Clawson | B61L 21/04 701/19 |
| 7,416,159 | B2 * | 8/2008 | Beaman | B61L 5/067 246/219 |

FOREIGN PATENT DOCUMENTS

| | | | |
|---|---|---|---|
| CN | 212313569 | U | 1/2021 |
| CN | 113335340 | A | 9/2021 |

* cited by examiner

SWITCH CONTROL METHOD FOR RAIL TRANSIT SIGNAL SYSTEM, AND APPARATUS FOR METHOD

TECHNICAL FIELD

The present disclosure relates to a rail transit signal system, in particular to a switch control method for a rail transit signal system, and an apparatus for the method.

BACKGROUND

In conventional signal systems, switch machines are controlled in a centralized manner by signal systems. During maintenance of a switch, it is needed to block the relevant switch on an operation interface by a dispatcher. After the dispatcher and a maintenance person complete a confirmation procedure, the maintenance person performs field maintenance operation on the switch. During the maintenance operation on the switch, the dispatcher is required to operate a switch command again, such that the maintenance operation on the switch excessively depends on normal working of the field maintenance person, the central dispatcher, and signal equipment, thus leading to lower efficiency of maintenance operation on the switch. Moreover, in an overhaul project of the signal system, the switch machine in a whole station yard can be verified in consistency only after the signal system is debugged and under the precondition that the signal system works normally. Since the two working missions are tightly coupled to each other, it is not conducive to the optimization of signal engineering project management.

Therefore, how to meet the requirement of local switch control and ensure the safety of the maintenance person and the operation has become a technical problem to be solved.

SUMMARY

To overcome the above defects existing in the prior art, an objective of the present disclosure is to provide a switch control method for a rail transit signal system, and an apparatus for the method.

The objective of the present disclosure may be achieved through the following technical solution:

According to one aspect of the present disclosure, provided is a switch control method for a rail transit signal system. When a switch control command of the signal system fails or the signal system confirms agreement with local switch control, the method is configured for performing maintenance operation on a switch via a local switch control apparatus.

As a preferred technical solution, the method specifically includes:

Step 1: a request stage: when preparing for switch maintenance operation, after a wayside safety confirmation person, a switch maintenance person, and an operator confirm the maintenance operation, pressing, by the wayside safety confirmation person, a local control request button on a switch confirmation control panel;

Step 2: a confirmation stage: when the signal system works normally, receiving, by the signal system, a local control request signal; and when the signal system has established a movement authority for a train to pass through the switch, ensuring that the train returns to be outside the switch zone after collecting the status, sending a switching confirmation signal when the signal system confirms that there is no train occupying or passing through the switch, and immediately turning on a switching agreement indication lamp when a switching apparatus receives the switching confirmation signal from the signal system; and Step 3: an execution stage: when the switch maintenance person confirms that the "switching agreement indication lamp" positioned on a local switch control panel is turned on, executing operation of a "changeover switch", and immediately turning on a "local control mode indication lamp", such that a switching process of the local switch control is completed, and the switch maintenance person may start the switch maintenance operation.

As a preferred technical solution, in the Step 2, the confirmation stage further includes: when the signal system cannot work normally and the wayside safety confirmation person confirms that there is no train in and entering the switch zone, pressing a "bypass button" on the switch confirmation control panel, and immediately turning on the switching agreement indication lamp when the switching apparatus receives the switching confirmation signal from the signal system.

As a preferred technical solution, the method further includes a step of disabling the local switch control, specifically including:

a) pressing, by the switch maintenance person, a local control release button on the local switch control panel, and operating the "changeover switch" on the local switch control panel;

b) turning on a "centralized control mode indication lamp" on the local switch control panel; and c) disabling a local switch control mode.

According to another aspect of the present disclosure, provided is an apparatus for the switch control method for a rail transit signal system, including a local switch control panel and a switch confirmation control panel.

As a preferred technical solution, the local switch control panel includes a centralized control mode indication lamp, a local control mode indication lamp, a local control release button, a changeover switch, a switch normal status indication lamp, a switch reverse status indication lamp, a switch normal operation button, and a switch reverse operation button.

As a preferred technical solution, a switch confirmation control panel includes a bypass button, a switching agreement indication lamp, and a local control request button.

As a preferred technical solution, the local control request button is a non-stick button;

after confirming operational procedures of local switch control with a dispatcher, a maintenance person presses the local control request button and the operation changeover switch, and after the signal system performs confirmation or the maintenance person presses the bypass button, switch control is transferred to local control, and the local control mode indication lamp, the switch normal status indication lamp, and the switch reverse status indication lamp are simultaneously turned on; and when the maintenance person completes maintenance operation of a switch machine and operates the "changeover switch" to be in a centralized control mode and presses the "local control release button" on the wayside local switch control panel, the centralized control mode indication lamp is automatically turned on, and the local switch control mode indication lamp and a switch position indication lamp are automatically turned off.

As a preferred technical solution, the apparatus is flexibly arranged outdoors or indoors according to a project requirement.

As a preferred technical solution, the apparatus is applicable to a train autonomous control system (TACS), a China train control system (CTCS), a European train control system (ETCS), a positive train control (PTC) system, an incremental train control system (ITCS), and a communication based train control (CBTC) system.

Compared to the prior art, the present disclosure has the following advantages:

1) The present disclosure meets the requirement of the local switch control and ensures the safety of the maintenance person and operation.
2) In the present disclosure, to ensure the maintainability, safety and availability of the switch machine, when the switch control command of the signal system fails or the signal system confirms the agreement with the local switch control, the maintenance person may perform the maintenance operation on the switch via the local switch control apparatus.
3) The present disclosure is independent of the switch control mode of the signal system, and achieves more flexible operation on the switch machine.
4) In the present disclosure, the maintenance operation on the switch machine may be carried out together with the maintenance operation on the signal system, which improves the maintainability of the switch machine.
5) The independent control on the switch in the present disclosure facilitates the optimization of engineering project management in a signal system transition project.
6) The local switch control apparatus in the present disclosure can reduce human errors caused by relay replacement, thereby reducing impact on operation lines.

DETAILED DESCRIPTION OF THE EMBODIMENTS

The technical solutions in the embodiments of the present invention will be clearly and completely described below with reference to the accompanying drawings in the embodiments of the present disclosure. Apparently, the described embodiments are part rather than all of the embodiments of the present disclosure. All other embodiments obtained by those of ordinary skill in the art based on the embodiments of the present disclosure without creative efforts should fall within the scope of protection of the present disclosure.

In a switch control method and apparatus in the present disclosure, a switch control mode is divided into a centralized control mode and a local control mode.

In the centralized control mode, a switch is controlled by a signal system, namely, the switch is controlled to be transited by the signal system. The signal system sends an operational command to a switch machine on a basis of an operational plan and an operational requirement. A switch control system automatically completes switch position transition of the switch. A position indication signal is output to the signal system, so as to complete the position transition of the switch.

In the local control mode, the switch is controlled locally, namely, the switch is controlled to be transited by a maintenance person according to a requirement of maintenance operation. The maintenance person completes the transition of the switch on a basis of a local switch control apparatus. In this mode, switching from the centralized control mode to the local control mode is completed through three steps of "request", "confirmation" and "execution".

In a request stage, when preparing for switch maintenance operation, after a wayside safety confirmation person, the switch maintenance person, and an operator confirm the maintenance operation, the wayside safety confirmation person presses a local control request button on a switch confirmation control panel.

Figure 5:
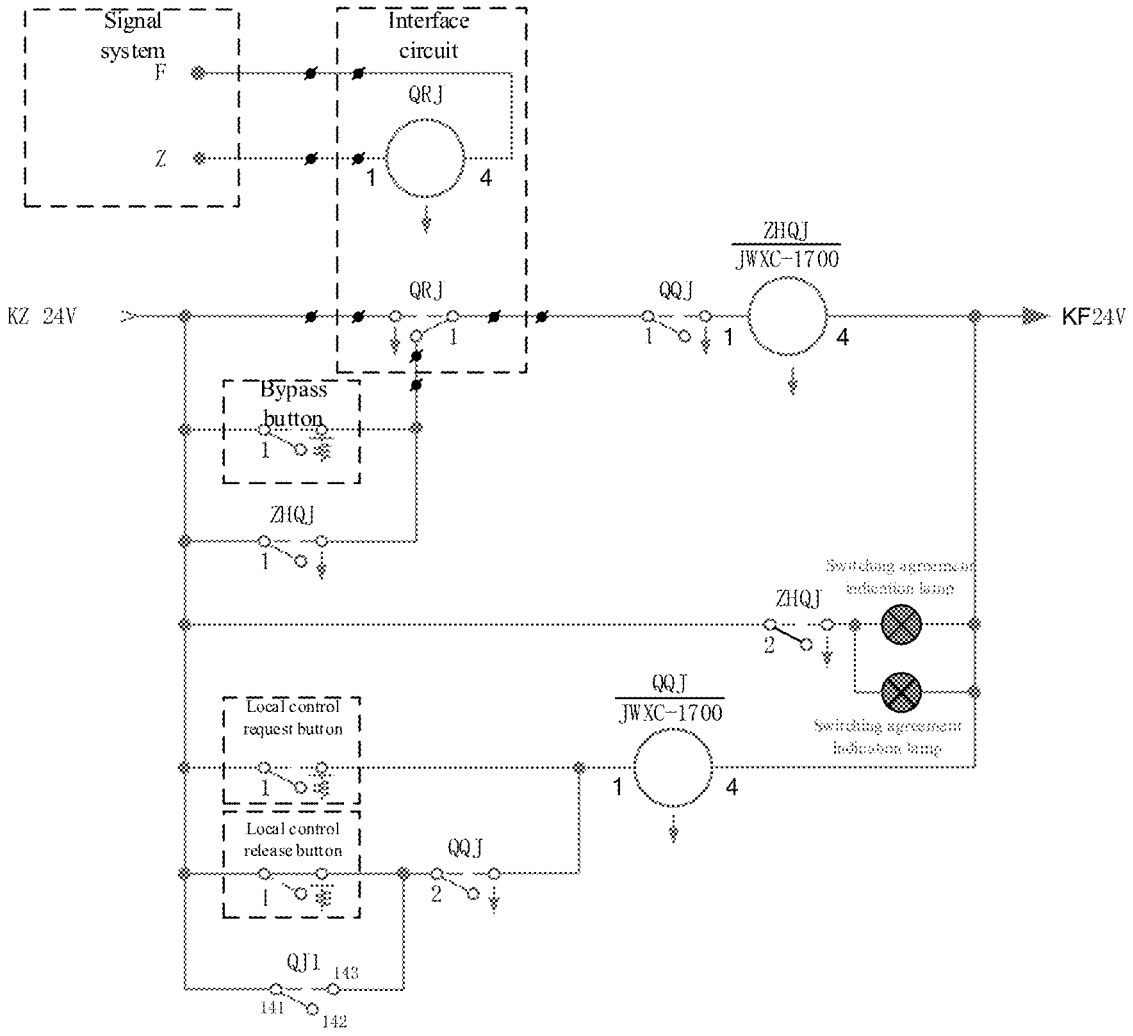
FIG. 5 is a diagram of a circuit for switch request and confirmation.

In a confirmation stage, when the signal system works normally, the signal system receives a local control request signal (a switching request relay—QQJ as shown in FIG. 5), and the signal system no longer establishes a movement authority for a train to pass through the switch, and does not allow individual operation of the switch. When the signal system has established the movement authority for the train to pass through the switch, it is ensured that the train returns to be outside a switch zone after the status is collected, and a switching confirmation signal (a switching confirmation relay—QRJ as shown in FIG. 5) is sent when the signal system confirms that there is no train occupying or passing through the switch; and a switching agreement indication lamp (as shown in FIG. 1) is immediately turned on when a switching apparatus receives the switching confirmation signal from the signal system.

Figure 1:
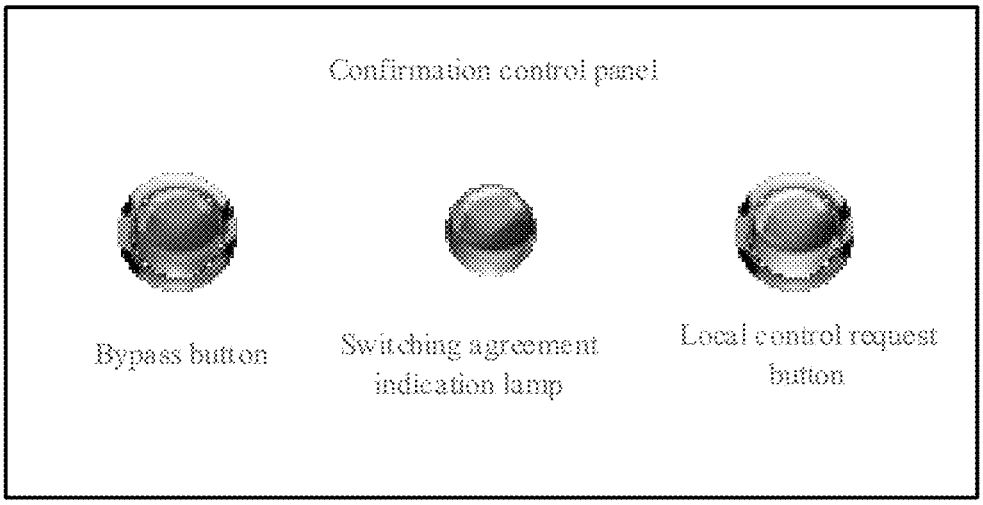
FIG. 1 is an example diagram of a switch confirmation control panel.

When the signal system cannot work normally and the wayside safety confirmation person confirms that there is no train in and entering the switch zone, a "bypass button" is pressed on the confirmation control panel, and the switching agreement indication lamp (as shown in FIG. 1) is immediately turned on when the switching apparatus receives the switching confirmation signal from the signal system.

In an execution stage, when the switch maintenance person confirms that the "switching agreement indication lamp" positioned on a local switch control panel is turned on, operation of a "changeover switch" may be executed, and a "local control mode indication lamp" is immediately turned on, such that a switching process of the local switch control is completed, and the switch maintenance person may start the switch maintenance operation. During the maintenance, the maintenance person operates the control command of the switch machine on the basis of the requirement of the switch maintenance operation, without the assistance of the dispatcher.

Figure 6:
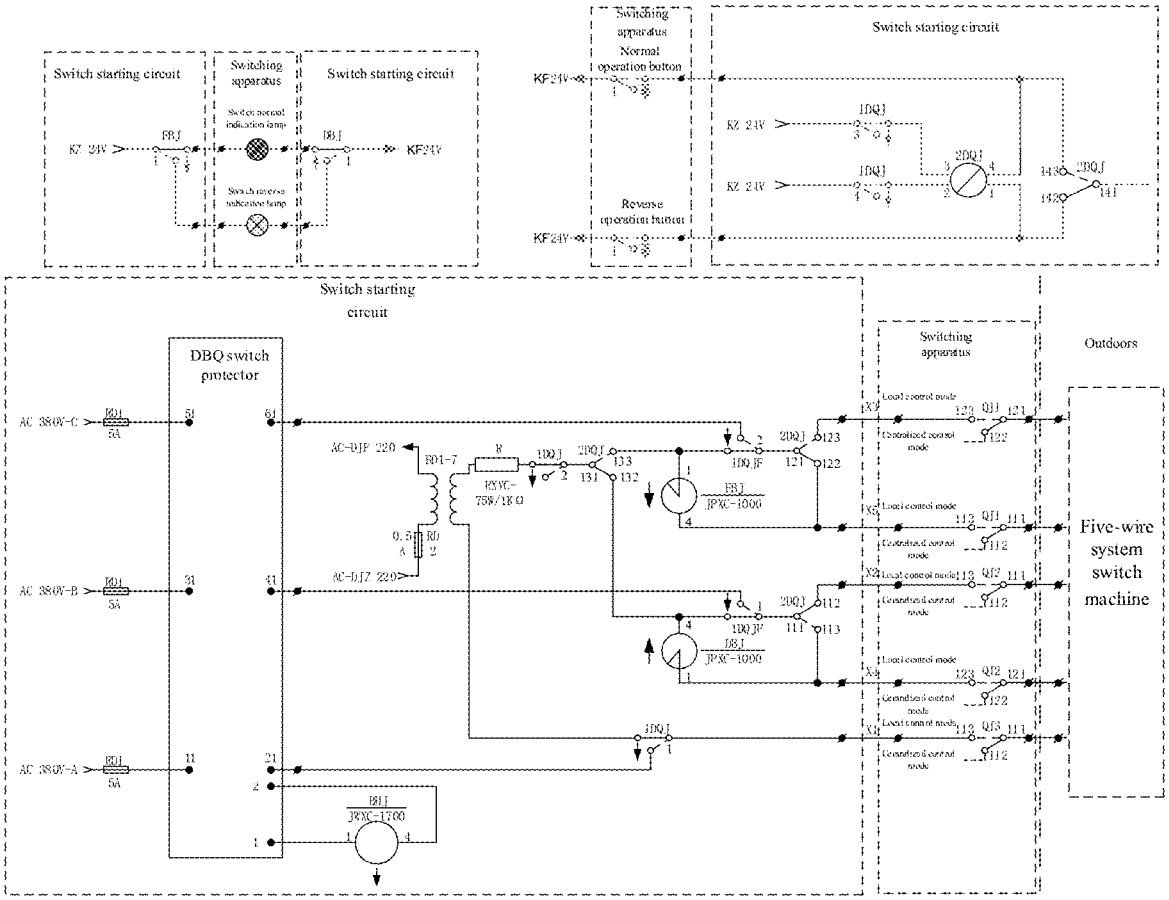
FIG. 6 is a schematic example diagram of the switching circuit.

A local switch control starting circuit will be independent of a switch starting circuit in the centralized control mode, as shown in FIG. 6.

Figure 2:
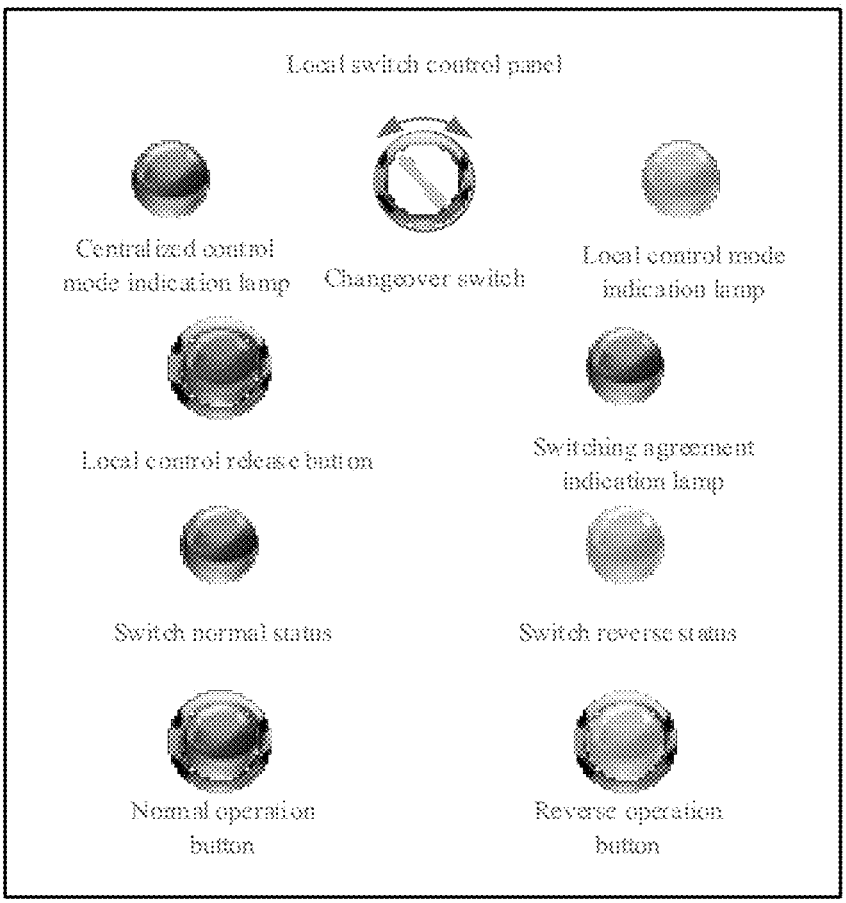
FIG. 2 is an example diagram of a local switch control panel.

The wayside local switch control panel includes a centralized control mode indication lamp, the local control mode indication lamp, a local control release button, the changeover switch, a switch normal status indication lamp, a switch reverse status indication lamp, a switch normal operation button, and a switch reverse operation button, as shown in FIG. 2.

the switch confirmation control panel includes the bypass button, the switching agreement indication lamp, and the local control request button, as shown in FIG. 1.

Figure 3:
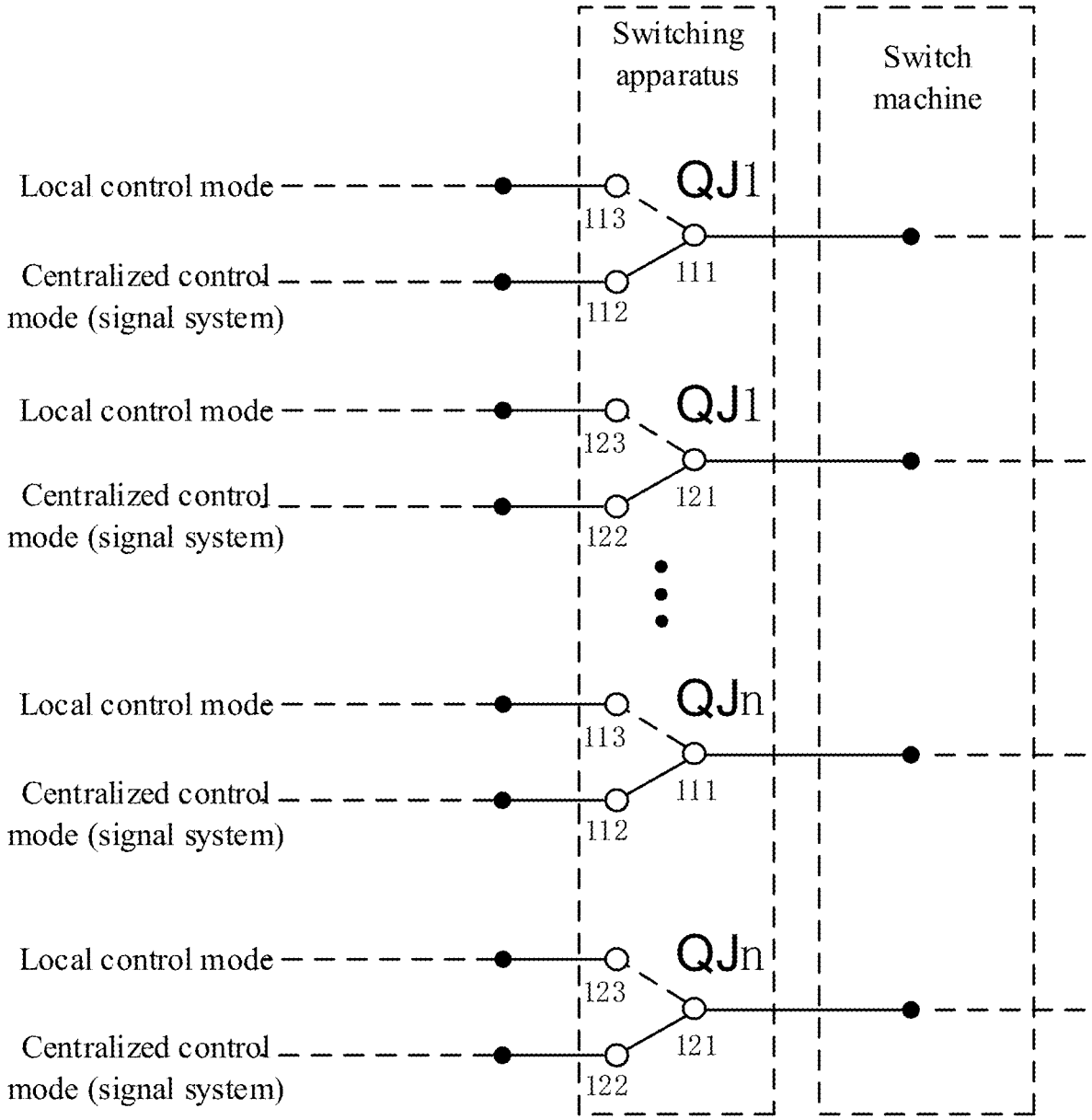
FIG. 3 is a schematic principle diagram of a switching circuit.

The local control request button is designed to be a non-stick button. After confirming operational procedures of local switch control with the dispatcher, the maintenance person presses the "local control request button" (as shown in FIG. 2) and the "operation changeover switch" (a stick switch), and after the signal system performs confirmation or the maintenance person presses the "bypass button", switch control as shown in FIG. 3 is transferred to local control, and the local switch control mode indication lamp and a switch position indication lamp are simultaneously turned on.

Figure 4:
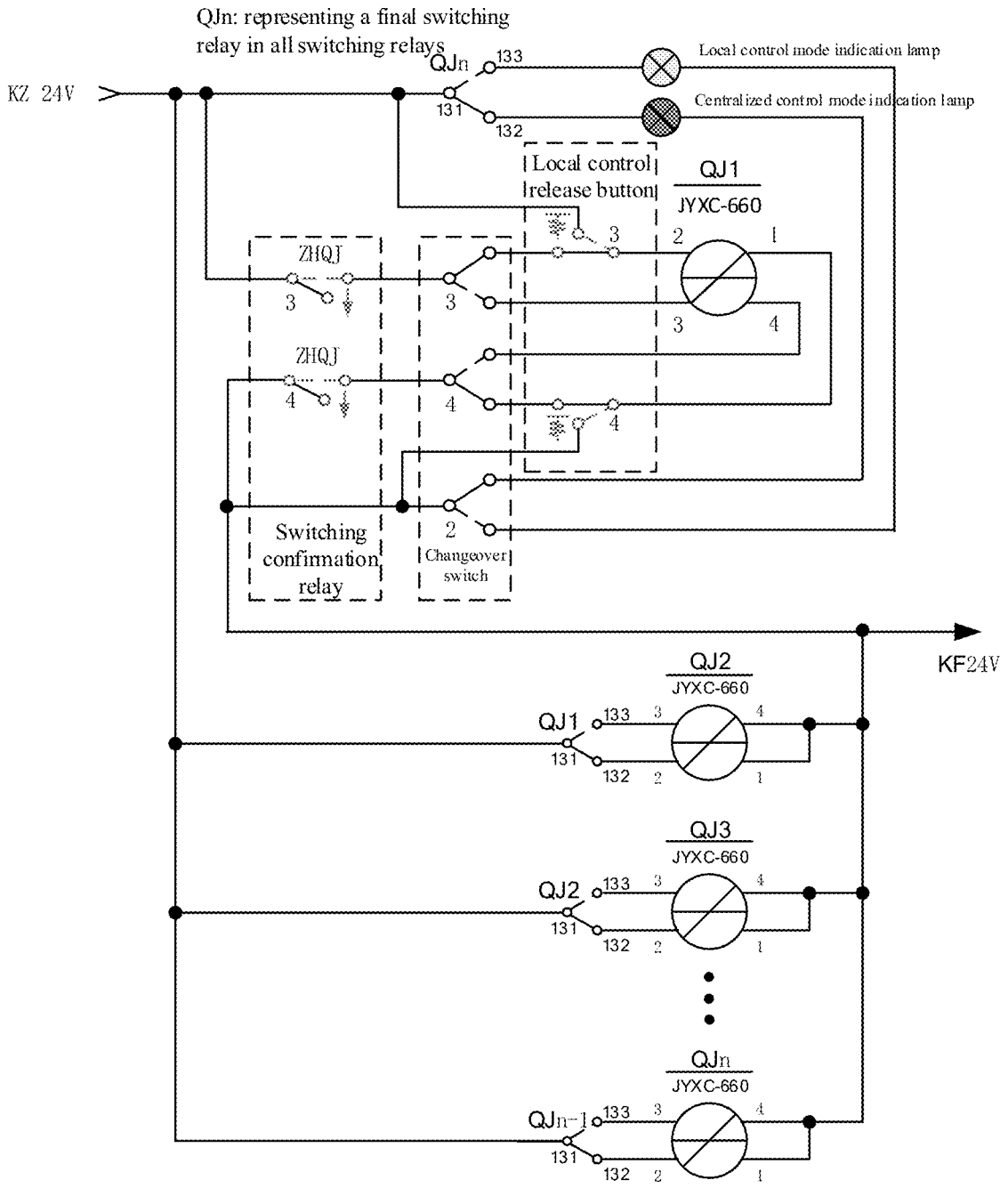
FIG. 4 is a diagram of a circuit for switching control.

When the maintenance person completes the maintenance operation of the switch machine and operates the "changeover switch" to be in the centralized control mode and presses the "local control release button" on the wayside local switch control panel, on a basis of a circuit diagram shown in FIG. 4, the centralized control mode indication lamp is automatically turned on, and the local switch control mode indication lamp and the switch position indication lamp are automatically turned off.

The local switch control apparatus may be flexibly arranged outdoors or indoors according to a project requirement. The method may be used for a train autonomous control system (TACS), and may also used for signal systems in other modes such as a China train control system (CTCS), a European train control system (ETCS), a positive train control (PTC) system, an incremental train control system (ITCS), and a communication based train control (CBTC) system. Therefore, the claims of the method are also applicable to these systems and similar ones.

SPECIFIC EMBODIMENTS

Both FIG. 1 and FIG. 2 are example diagrams of a control panel. To ensure that the safety confirmation and the switch maintenance operation are respectively carried out by persons playing different roles, it is necessary to determine that switching of the control mode is completed on different interfaces. Control panels may be arranged in different places according to the needs of engineering design, so as to prevent the impact on operation safety due to misoperation of single person. FIG. 1 is used for the confirmation person to press the local control request button on the switch confirmation control panel after obtaining a local operation authority, determining that the signal system cannot work normally, and confirming that there is no train in or about to enter the switch zone. The switch maintenance person may operate the changeover switch in the "local switch control panel" as shown in FIG. 2 to change a whole switch control circuit to be in the local control mode for controlling the switch locally (as shown in FIG. 6).

After the switch maintenance person confirms the completion of the switch maintenance operation, it is necessary to press the "local control release button" in the "local switch control panel" as shown in FIG. 2 and change the "changeover switch" to be in the centralized control mode for transferring the switch control to the centralized control (that is, the control by the signal system).

Embodiments: Referring to FIG. 3

The centralized control mode and the local control mode are isolated by a switching relay. The current control state of switch control is that the switch is controlled by the signal system in the centralized control mode. When it is necessary to switch the control mode to the local control mode, after manual confirmation of the operation safety of the switch, all outdoor signal equipment may be connected to a local switch control circuit for controlling the outdoor equipment. The outdoor switch machine is connected to be in different control modes through different contacts of the switching relay (QJ). According to the characteristics that the centralized control mode and the local control mode belong to the same safety system and the safety levels on two sides are the same, a polarized relay (also referred to as a polar stick relay) is used in circuit design. After a coil of the polarized relay is energized by a forward current, an armature is actuated, such that a contact is attracted by a normal/reverse contact and is kept at a current position; and when an energizing current of the coil is interrupted, the armature of the polarized relay will not act accordingly, and the polarized relay cannot act again until the coil of the relay is reversely energized.

Hard wires of the outdoor signal equipment are collected to a wire distribution cabinet. The hard wires in the wire distribution cabinet are connected to a middle contact of the relay, and are respectively connected to be in the centralized control mode and the local control mode through the normal contact and the reverse contact of the relay.

Referring to FIG. 4:

The process of switching the centralized control mode and the local control mode will affect the operation and safety of a line, so the switching steps need to be manually confirmed and carefully operated. The design solution not only ensures the convenience of operation, but also reduces the possibility of misoperation by the person, so in the process of switching, the staffs with different responsibilities are required to respectively operate the "local control request button" and the "changeover switch", and only when the two switches are operated (there is no order between them) to make the "switching confirmation relay" (ZHQJ) energized (as shown in FIG. 5), the "switching relay" (QJ) is allowed. The local control request button (the non-stick button), the "switching confirmation relay" (ZHQJ), the centralized control mode indication lamp (green), and the local control mode indication lamp (yellow) are designed in the circuit. When the centralized control or local control mode is in use and one or several switching relays (QJ) need to be replaced and maintained, a contact attraction position of a replaced relay (QJ) is likely to be inconsistent with that in the current operating system. To avoid the impact on the operation due to this situation, all the switching relays are designed to act in sequence. After the switching relay QJ1 is energized and the contact of the QJ1 acts, the QJ2 is driven to act, and the subsequent relays are driven to act in sequence until the action of the final relay is completed. When one or several relays are replaced and current contact positions of these relays are inconsistent with previous contact positions of the relays, after replacement, a new relay will conduct the energizing circuit of this relay and change the pole according to the contact attraction position of the previous relay, so as to change the pole to a consistent position required by the current system, thus finally ensuring that all the switching relays (QJ1, QJ2 . . . QJn) are synchronized.

The number n of the switching relays depends on the number of hard wire interfaces between the switch machine and the starting circuit, as shown in FIG. 6. There are five hard wires for indoor and outdoor interfaces of a five-wire-system switch, so three switching relays need to be used on a basis of the number of the contacts of the switching relay (QJ) and two groups of available reinforced contacts of the relay JYXC-660.

Referring to FIG. 5:

The circuit shown in FIG. 5 is used for request and confirmation of the local switch control mode.

During the operation, due to the maintenance requirement or other specific operation scenarios, it is necessary to change the switch to be in the local control mode. After fully confirming with the dispatcher, the operator may press the "local control request button", and the "wayside switching request relay" (QQJ) is energized. After collecting the status of the "wayside switching request relay" (QQJ), the signal system blocks the switch and an affected side zone, and immediately outputs the status to the "switching confirmation relay of the signal system" (QRJ) after determining that there is no risk that the train will enter the switch zone. Both the request of the maintenance person and the confirmation of the signal system are completed, so both the "wayside switching request relay" and the "switching confirmation relay of the signal system" are energized to finally trigger the "switching confirmation relay" (ZHQJ) to be energized, so as to determine that the current switching mode is the local control mode.

When the switch needs to be changed to be in the local control mode in a case where the signal system is not enabled yet or has a fault, the operator may press the "local control request button", and the "wayside switching request relay" (QQJ) is energized. After the signal system collects the status of the "wayside switching request relay" (QQJ), the operator fully confirms with the dispatcher and confirms that the train in the switch zone is safe, and the "bypass button" is pressed to trigger the "switching confirmation relay" (ZHQJ) to be energized, so as to determine that the current switching mode is the local control mode.

After the switch maintenance operation is completed, when it is necessary to switch the local control mode to the centralized control mode, the changeover switch must be operated to be in the centralized control mode first, and then the local control release button must be pressed, which leads to the disconnection of a self-stick circuit of the "wayside switching request relay" (QQJ), thus causing the relay to fall off due to deenergization. When the signal system collects the status that the "wayside switching request relay" (QQJ) and the "switching confirmation relay" (ZHQJ) are invalid, the switch is unblocked and is completely controlled by the signal system to complete the whole switching process.

Referring to FIG. 6:

Taking the circuit of the five-wire-system switch machine commonly used in rail transit as an example, the switch machine may be controlled in different scenarios of the centralized control mode and the local control mode. This patent is also applicable to other types of switch machines, such as a four-wire-system switch, a six-wire-system switch, a buried switch for a tram, a straddle monorail, and a switch system (or equipment) such as a suspension monorail.

The relays involved in all the circuit diagrams are shown in Table 1:

TABLE 1

| Relay name | Relay meaning | Relay model number | Relay type |
|---|---|---|---|
| QJ(1-n) | Switching relay (1-n) | JYXC-660 | Polar stick relay (First and second groups of contacts are reinforced contacts) |

TABLE 1-continued

| Relay name | Relay meaning | Relay model number | Relay type |
|---|---|---|---|
| QRJ | Switching confirmation relay of signal system | JWXC-1700 | Neutral relay |
| QQJ | Wayside switching request relay | JWXC-1700 | Neutral relay |
| ZHQJ | Switching confirmation relay | JWXC-1700 | Neutral relay |

The relay models involved in all the circuit diagrams are only examples. The relay types involved in the circuits described in this patent are not limited to the models of Chinese railway signal relays, and are applicable to all relay types meeting safety requirements.

The buttons involved in all the circuit diagrams are shown in Table 2:

TABLE 2

| Button name | Button type |
|---|---|
| Changeover switch | Stick switch/button |
| Local control request button | Non-stick switch/button |
| Local control release button | Non-stick switch/button |
| Bypass button | Non-stick switch/button |

The buttons or switches involved in all the circuit diagrams are only examples. The buttons involved in the circuits described in this patent may belong to any one of the buttons meeting the safety requirements.

Figure 7:
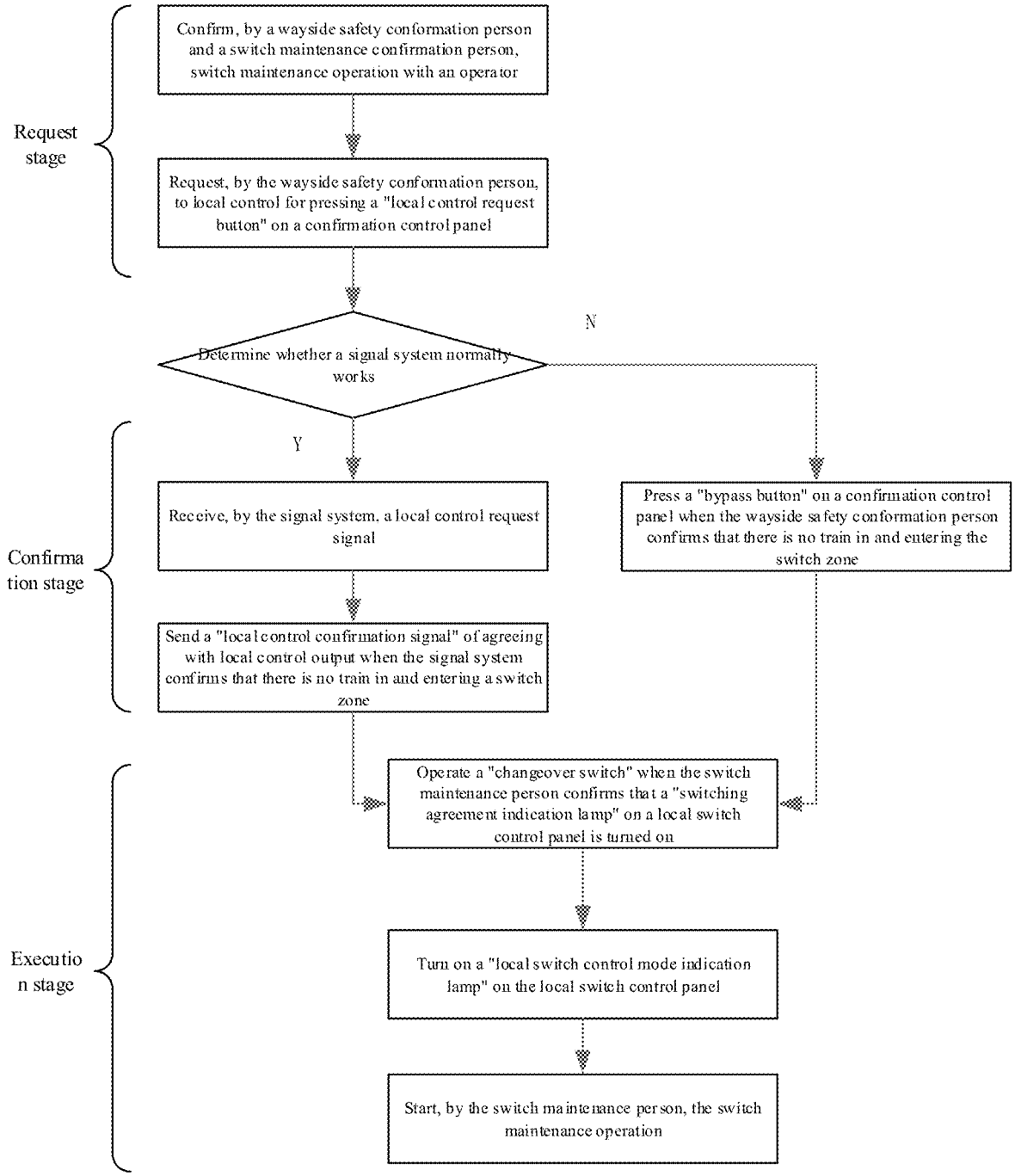
FIG. 7 is a flowchart of requesting for local switch control.

Referring to FIG. 7, the flowchart of requesting for local switch control describes the process of switching the switch to be in the local control mode.

The process is divided into the three stages of request, confirmation, and execution.

In the request stage, when preparing for the switch maintenance operation, firstly, the wayside safety conformation person and the switch maintenance person confirm the switch maintenance operation with the operator; and secondly, the wayside safety conformation person requests for local control and presses the "local control request button" on the confirmation control panel (as shown in FIG. 1).

In the confirmation stage, thirdly, when the signal system works normally, the signal system receives the local control request signal (the switching request relay -- QQJ as shown in FIG. 5), and the signal system no longer establishes the movement authority for the train to pass through the switch, and does not allow the individual operation of the switch; when the signal system has established the movement authority for the train to pass through the switch, it is ensured that the train returns to be outside the switch zone after the status is collected, and the switching confirmation signal (the switching confirmation relay -- QRJ as shown in FIG. 5) is sent when the signal system confirms that there is no train occupying or passing through the switch;

fourthly, when the signal system cannot work normally and the wayside safety confirmation person confirms that there is no train in and entering the switch zone, the "bypass button" is pressed on the confirmation control panel; and fifthly, when the switching apparatus receives the switching confirmation signal of the signal system or the command of the "bypass button", the switching agreement indication lamp (as shown in FIG. 1) is immediately turned on.

In the execution stage, sixthly, when the switch maintenance person confirms that the "switching agreement indication lamp" on the "local switch control panel" is turned on, the "changeover switch" is operated, and the "local control mode indication lamp" is immediately turned on; and seventhly, the switch maintenance person may start the switch maintenance operation after confirming that the "local control mode indication lamp" is turned on. During the maintenance, the maintenance person operates the control command of the switch machine on the basis of the requirement of the switch maintenance operation, without the assistance of the dispatcher.

Figure 8:
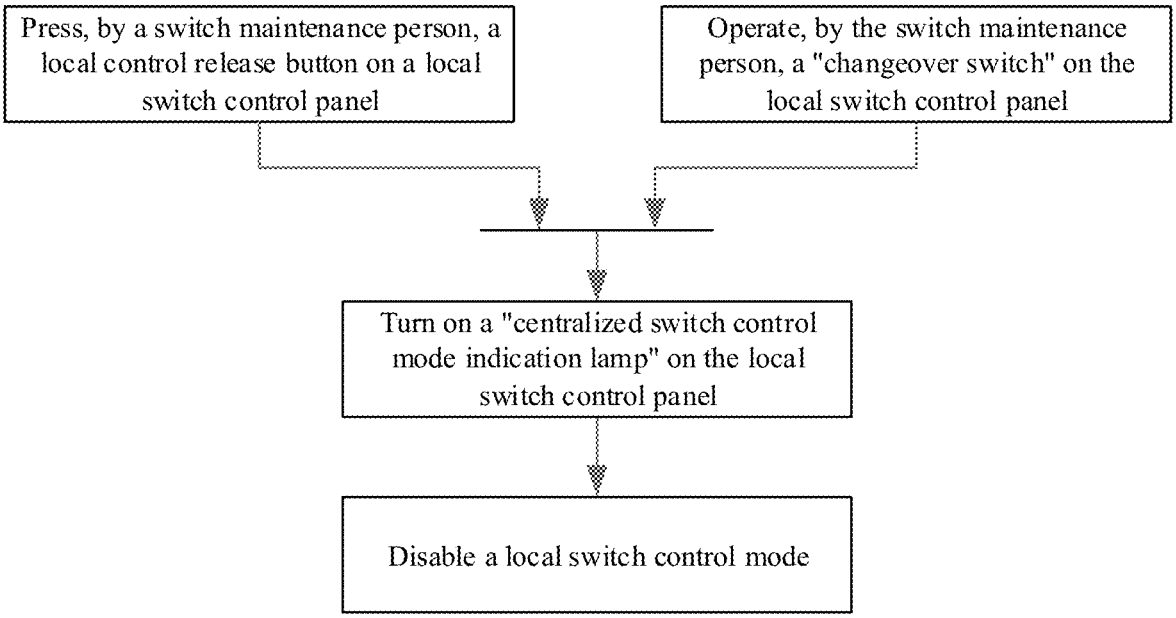
FIG. 8 is a flowchart of disabling local switch control.

Referring to FIG. 8, it is a flowchart of disabling local switch control, in which:

firstly, the switch maintenance person presses the local control release button on the local switch control panel, and operates the "changeover switch" on the local switch control panel;

secondly, the "centralized switch control mode indication lamp" on the local switch control panel is turned on; and thirdly, the local switch control mode is disabled.

The above is only the specific implementation of the present disclosure, but the scope of protection of the present disclosure is not limited thereto. Any of those skilled in the art may easily think of various equivalent modifications or substitutions within the technical scope of the present disclosure, and these modifications or substitutions should be included in the scope of protection of the present disclosure. Therefore, the scope of protection of the present disclosure should be subject to the appended claims.

The invention claimed is:

1. A switch control method for a rail transit signal system, the method being configured for performing maintenance operation on a switch via a local switch control apparatus when a switch control command of the signal system fails or the signal system confirms agreement with local switch control, wherein the method comprises:

Step 1: a request stage: when preparing for switch maintenance operation, after a wayside safety confirmation person, a switch maintenance person, and an operator confirm the maintenance operation, pressing, by the wayside safety confirmation person, a local control request button on a switch confirmation control panel;

Step 2: a confirmation stage: when the signal system works normally, receiving, by the signal system, a local control request signal; and when the signal system has established a movement authority for a train to pass through the switch, ensuring that the train returns to be outside the switch zone after collecting the status, sending a switching confirmation signal when the signal system confirms that there is no train occupying or passing through the switch, and immediately turning on a switching agreement indication lamp when a switching apparatus receives the switching confirmation signal from the signal system; and Step 3: an execution stage: when the switch maintenance person confirms that the "switching agreement indication lamp" positioned on a local switch control panel is turned on, executing operation of a "changeover switch", and immediately turning on a "local control mode indication lamp", such that a switching process of the local switch control is completed, and the switch maintenance person may start the switch maintenance operation.

2. The switch control method for a rail transit signal system according to claim 1, wherein in the Step 2, the confirmation stage further comprises: when the signal system cannot work normally and the wayside safety confirmation person confirms that there is no train in and entering the switch zone, pressing a "bypass button" on the switch confirmation control panel, and immediately turning on the switching agreement indication lamp when the switching apparatus receives the switching confirmation signal from the signal system.

3. The switch control method for a rail transit signal system according to claim 1, wherein the method further comprises a step of disabling local switch control, specifically comprising:

a) pressing, by the switch maintenance person, a local control release button on the local switch control panel, and operating the "changeover switch" on the local switch control panel;

b) turning on a "centralized control mode indication lamp" on the local switch control panel; and c) disabling a local switch control mode.

4. An apparatus for a switch control method for a rail transit signal system, the method being configured for performing maintenance operation on a switch via a local switch control apparatus when a switch control command of the signal system fails or the signal system confirms agreement with local switch control, the apparatus comprising a local switch control panel and a switch confirmation control panel, wherein the local switch control panel comprises a centralized control mode indication lamp, a local control mode indication lamp, a local control release button, a changeover switch, a switch normal status indication lamp, a switch reverse status indication lamp, a switch normal operation button, and a switch reverse operation button, wherein a switch confirmation control panel comprises a bypass button, a switching agreement indication lamp, and a local control request button, wherein the local control request button is a non-stick button, after confirming operational procedures of local switch control with a dispatcher, a maintenance person presses the local control request button and the operation changeover switch, and after the signal system performs confirmation or the maintenance person presses the bypass button, switch control is transferred to local control, and the local control mode indication lamp, the switch normal status indication lamp, and the switch reverse status indication lamp are simultaneously turned on; and when the maintenance person completes maintenance operation of a switch machine and operates the "changeover switch" to be in a centralized control mode and presses the "local control release button" on the wayside local switch control panel, the centralized control mode indication lamp is automatically turned on, and the local switch control mode indication lamp and a switch position indication lamp are automatically turned off.

5. The apparatus according to claim 4, wherein the apparatus is flexibly arranged outdoors or indoors according to a project requirement.

6. The apparatus according to claim 4, wherein the apparatus is applicable to a train autonomous control system (TACS), a China train control system (CTCS), a European train control system (ETCS), a positive train control (PTC) system, an incremental train control system (ITCS), and a communication based train control (CBTC) system.

* * * * *